United States Patent [19]

Newell

[11] 4,169,547

[45] Oct. 2, 1979

[54] OINTMENT CONTAINER WITH FINGER ACTUATED PISTON

[75] Inventor: Robert E. Newell, Pinner, England

[73] Assignee: Glaxo Laboratories Limited, Greenford, England

[21] Appl. No.: 845,828

[22] Filed: Oct. 26, 1977

[30] Foreign Application Priority Data

Oct. 26, 1976 [GB] United Kingdom ..... 44384/76

[51] Int. Cl.[2] ..... B65D 35/30

[52] U.S. Cl. ..... 222/386

[58] Field of Search ..... 222/386, 389

[56] References Cited

U.S. PATENT DOCUMENTS

| | | | |
|---|---|---|---|
| 2,430,718 | 11/1947 | Jacobson | 222/386 |
| 3,099,370 | 7/1963 | Hein | 222/389 X |
| 3,791,560 | 2/1974 | Harris, Sr. | 222/386 |

FOREIGN PATENT DOCUMENTS

| | | | |
|---|---|---|---|
| 2254513 | 5/1974 | Fed. Rep. of Germany | 222/386 |
| 672062 | 12/1929 | France | 222/386 |
| 792291 | 12/1936 | France | 222/386 |
| 1444533 | 11/1966 | France | 222/386 |
| 596995 | 8/1959 | Italy | 222/386 |

*Primary Examiner*—David A. Scherbel

[57] ABSTRACT

A container has a body with a nozzle at one end. A plunger can be pushed through the body by the insertion of a finger of the user through the opening in the body so as to force the contents of the container out through the nozzle.

4 Claims, 4 Drawing Figures

OINTMENT CONTAINER WITH FINGER ACTUATED PISTON

BACKGROUND OF THE INVENTION

It is commonplace to pack creams for topical use in collapsible tubes which also serve as dispensers. Such tubes have a number of disadvantages. Thus, it is difficult or impossible to dispense the entire contents of such a tube. This leads to a waste of what is often an expensive substance. It is inherent in the design of such tubes that for a given quantity of cream to be packed a relatively long tube is required for any given diameter, the total tube volume being unusable. This in turn means that a relatively large space is required for the packing, storing or transport of quantities of tubes filled with creams. Finally, it is usually necessary to make collapsible tubes of expensive materials such as aluminium or tin because less expensive materials such as the soft plastics are for commercial and/or technical reasons often not suitable for use as collapsible tubes for creams. An object of the present invention is to provide a container which overcomes these disadvantages.

BRIEF SUMMARY OF THE INVENTION

The invention provides a container or dispenser for pasty substances, such as ointments, gels, creams or some liquids of suitable viscosity. For convenience of description, such substances are herein referred to as "creams". The container has a body which has at a forward end a dispensing nozzle communicating with the interior of the body and has at the rear end an opening through which a finger of the user of the container can be inserted, a dispensing plunger slidable inside the body, the said plunger being accessible through the open end of the body to enable the plunger to be urged towards the nozzle end of the body and discharge cream through the nozzle, sealing means between the plunger and the interior of the body to prevent egress of cream between the plunger and the body when the plunger is displaced to discharge the cream, and means for preventing the plunger tilting with respect of its axis when pressure is applied thereto. Preferably the plunger has a central pressure member accessible through the open end of the body.

BRIEF DESCRIPTION OF THE ACCOMPANYING DRAWINGS

FIG. 1 is a longitudinal section of a dispensing container constructed according to the invention, FIG. 2 is an exploded view, FIG. 3 is a transverse section through a plunger of the container, and FIG. 4 is a scrap view of a detail.

DESCRIPTION OF THE ILLUSTRATED EMBODIMENT OF THE INVENTION

Figure 1:
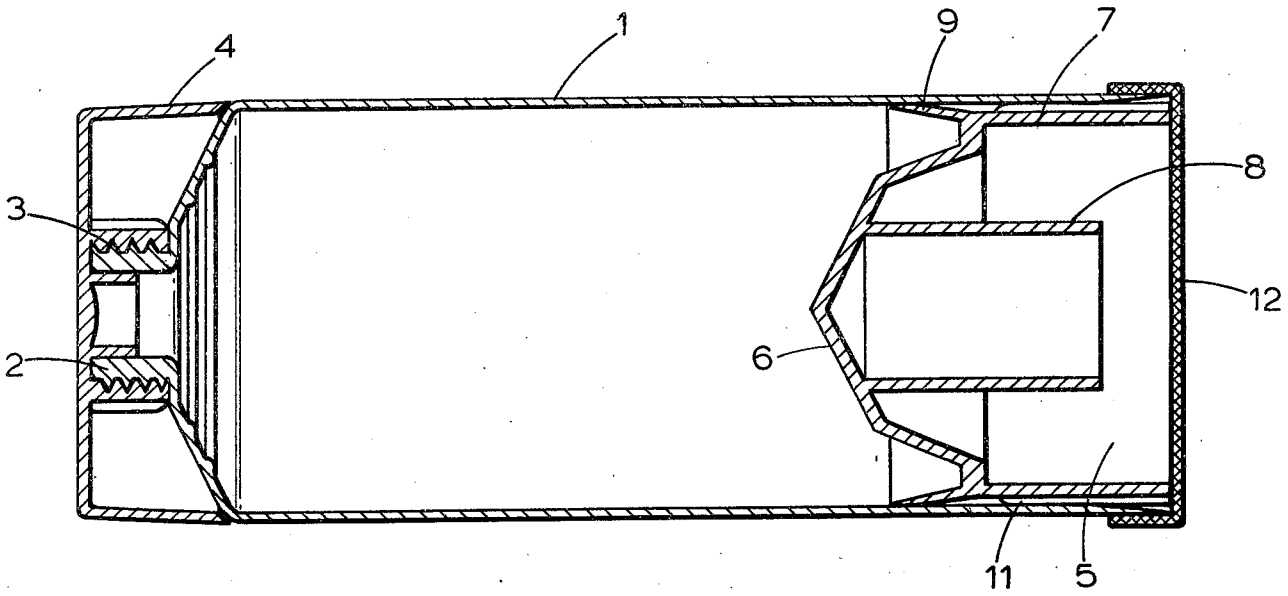
Figure 2:
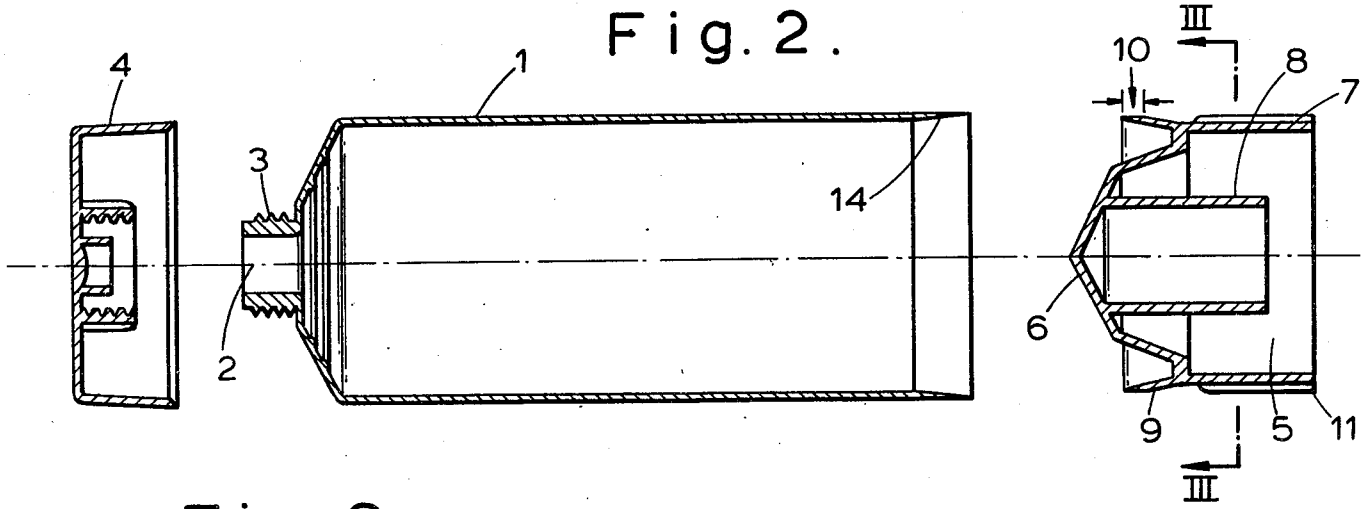

A combined container and dispenser for creams comprises a body of cylindrical cross-section. Although, as illustrated, the body is preferably of cylindrical cross-section it can be of any other convenient shape such as of elliptical or substantially rectangular cross-section. The body is conveniently made as an injection moulding of a suitable plastics material such as polypropylene. The area of the cross-section of the body may be of any convenient size, provided it is such that a finger of a person using the container can be inserted in the body. It has, therefore, been established that a convenient diameter of a cylindrical body is 30 mm. The body has a generally conical forward end with an outlet nozzle 2 leading forwards out of that end of the body. The nozzle communicates with the interior of the body. The nozzle has an external screw thread 3. A closure cap 4 is screwed on the nozzle 2 and encloses the entire forward or nozzle end of the body. As an alternative, the closure cap may be a snap fit on the nozzle or body.

A plug, plunger or piston 5, hereinafter referred to as a "plunger" is arranged inside the body 1. This plunger 5 is of a shape which is complimentary to that of the interior of the body 1 but the area of the cross-section of the plunger is slightly smaller than the area of the cross-section of the body. The plunger is conveniently made as an injection moulding of a plastics material such as polypropylene or polyethylene. A cream to be dispensed is arranged inside the forward portion of the body between the forward end of the plunger and the rear end of the nozzle end of the body. To facilitate insertion of the plunger 5 in the body 1, the open end of the body has an internal angled lead-in portion 14. The forward face 6 of the plunger 5 has a conicity complimentary to that of the interior surface of the forward end of the body. The plunger is hollow and has a cylindrical skirt 7. Extending axially within the skirt 7 is a pressure member in the form of a tube 8 or a rod. Thus, pressure applied to the plunger by pressing a finger on the tube 8 forces cream out of the body through the nozzle 2, provided, of course, that the cap 4 has been removed. When pressure on the plunger is released, the plunger 5 will remain in the body 1 at the position it occupies when pressure is released.

A suitable sealing means must be provided between the forward space of the plunger and the inside of the body in order to prevent egress of cream when the plunger 5 is moved towards the nozzle 3. Such sealing means is provided by a flexible collar 9 which extends forwards from the skirt 7 of the plunger. The outer periphery of this collar 9 is greater than that of the outside of the plunger itself and is greater than the cross-section of the interior of the body 1 so that the collar 9 makes a sealing and sliding fit with the interior of the body. The collar 9 has sufficient resilience to ensure that it makes a sealing fit with the interior of the body. The collar 9 has a dual function as it provides an airtight seal when cream is not being dispensed from the container and it also prevents the creep of cream past the plunger 5 when it is moved to discharge cream.

Figure 4:
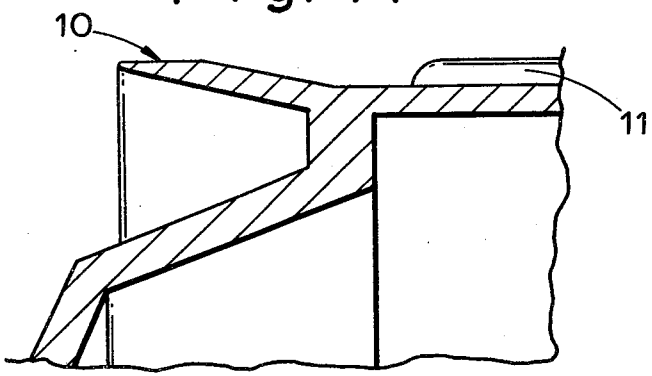
Figure 3:
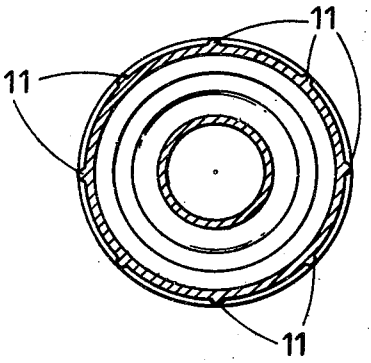

Means are provided to prevent or reduce lateral or tilting movement of the plunger with respect to the axis of the body because such movement could impair the efficiency of the seal. Such means is provided by a "flat" portion 10 illustrated to an exagerated scale in FIG. 4. This flat is a portion of the plunger the generatrix of the shape of which is parallel with the axis of the plunger and body. Additionally, ribs 11 run lengthwise of the surface of the skirt 7 of the plunger 5 to assist in preventing tilt of the plunger. Alternatively, ribs can be provided to run peripherally round the external surface of the plunger or there can be protuberances on the outside of the plunger.

A tamper-indicating seal 12 is provided at the rear end of the body, although such a seal is not essential. This seal is, conveniently, a frangible thin sheet of aluminium foil which covers the rear end of the body and makes it impossible to press on the plunger to dispense cream from the container without first breaking the seal. Thus, it is possible to see at a glance whether or not the container has already been used.

A flexible foam or porous pad can be fitted to the nozzle so that the cream dispensed from the interior of the body is dispensed through the pad. In another modification an elongated tube can be fitted to the nozzle 3 to increase its length or a blunt blade or spatula can be fitted to the nozzle to assist in distributing cream over an area of a patient using a dispenser. If desired a shaped spout can be fitted to the nozzle.

What is claimed is:

1. A dispenser for creams and the like, the dispenser comprising a hollow body member; a dispensing nozzle at the forward end of the body and communicating with the interior thereof; an opening at the rear end of the body; a dispensing plunger slidably retained in the interior of the body, one face of the plunger being directed forwardly towards the dispensing nozzle and a second opposing face being rearwardly directed and accessible through the open rear end of the hollow body to enable the plunger to be urged towards the nozzle end of the body; an outwardly flaring, resilient collar extending forwardly of and secured to the plunger, the forward edge portion of the flaring collar having an outer periphery pressing against the interior surface of the hollow body, so as to form a sliding, sealing fit therewith, the diameter of the outer periphery of the flaring collar would be greater than that of the internal diameter of the hollow body if the collar were freed from the restraint of the hollow body; said forward edge portion of said flaring collar forming a longitudinally extended surface which is parallel to the interior surface of the hollow body when said plunger is placed in said hollow body member; a skirt portion extending rearwardly from the forward face of the plunger and a plurality of longitudinally extending ribs formed on the outer periphery of the skirt and in contact with the internal surface of the hollow body; whereby the plunger is sealably connected to the interior of the hollow body and is prevented from tilting with respect to the axis of the body when pressure is applied against the underside of the plunger.

2. A dispenser in accordance with claim 1 wherein the plunger, collar and skirt are formed as an integral unit.

3. A dispenser as claimed in claim 2, having a removable screw cap to cover the nozzle end of the dispenser.

4. A dispenser as claimed in claim 2, wherein the rear-end of the body is closed by a frangible cover whereby access to the plunger can only be obtained by breaking the cover.

* * * * *